US006036337A

United States Patent [19]

Belfer

[11] Patent Number: 6,036,337

[45] Date of Patent: Mar. 14, 2000

[54] VIRTUAL AXIS LIGHTING FIXTURE

[76] Inventor: Bruce D. Belfer, 1703 Valley Rd., Ocean, N.J. 07712

[21] Appl. No.: 09/083,317

[22] Filed: May 22, 1998

[51] Int. Cl.[7] ..... F21V 21/26; F21V 19/02

[52] U.S. Cl. ..... 362/287; 362/285; 362/372; 362/257; 362/269

[58] Field of Search ..... 362/257, 269, 362/271, 275, 285, 287, 372

[56] References Cited

U.S. PATENT DOCUMENTS 3,018,364 1/1962 Wenman ..... 362/269
5,609,413 3/1997 Lecluze ..... 362/285

*Primary Examiner*—Cassandra Spyrou
*Assistant Examiner*—Audrey Chang
*Attorney, Agent, or Firm*—Ezra Sutton

[57] ABSTRACT

A lighting fixture having a rotatable lamp assembly including a housing having a rear wall and side walls for forming an interior compartment; the two side walls having first and second arc-shaped track formed therein; and the housing having mounting means for mounting the housing. The lighting fixture further includes a support and control assembly mounted within the interior compartment of the housing, which includes a U-shaped support bracket having upper and lower arc-shaped tracks formed therein. The lighting fixture also includes first and second arc mounting plate members for movably mounting the support and control assembly on the first and second arc-shaped tracks on the two side walls for movement along the first and second arc-shaped tracks. The lamp assembly has a third arc mounting plate member for movably mounting the lamp assembly on the upper and lower arc-shaped tracks of the U-shaped support bracket for movement along the upper and lower arc-shaped tracks. The lamp assembly rotates within the interior compartment of the housing about a virtual center or virtual axis. A first servomotor drives the support and control assembly and a second servomotor drives the lamp assembly which combine to rotate the lamp assembly in a 360° degree circle about a radius of curvature having a center of curvature above the lamp assembly.

67 Claims, 7 Drawing Sheets

VIRTUAL AXIS LIGHTING FIXTURE

FIELD OF THE INVENTION

This invention relates to a rotatable lighting fixture having a virtual axis. More particularly, this virtual axis lighting fixture is compact in size for use in industrial, commercial and residential applications in which the light rays may be focused in multiple directions from a recessed or semi-recessed location within a ceiling, wall or floor structure.

BACKGROUND OF THE INVENTION

Adjustable lighting systems often include recessed or semi-recessed lighting fixtures. In general, these adjustable lighting systems include a reflector or baffle device for producing a concentrated beam of light directed to a particular area normally directly beneath the lighting fixture. Often the direction of the beam of light must be altered to highlight and accent objects or areas within the room for the proper illumination effect needed.

Prior art adjustable, recessed lighting fixtures have been very difficult to adjust in manually adjustable lighting fixtures, as well as in motorized lighting fixtures. For example, some prior art manually adjustable lighting devices require the removal of the lamp or bulb before effecting the adjustment in directing the light beam to its proper location within the room to illuminate a particular object or area properly. Often this process must be repeated several times on gimbal or swivel lighting fixtures to obtain the correct illumination and light beam distribution of the object or area to be illuminated. Each minor adjustment of the lighting fixture requires removal and replacement of the lamp, a very time consuming process.

Motorized lighting fixtures are also difficult to adjust as the direction of the beam of light must be altered several times in order to accent or light up particular objects or areas for the proper illumination effect needed. The automated movement of the lamp is only in a two (2) dimensional plane (or an X & Y axis only) such that the movement of the lamp is about a central point (+), so that pinpointing a given area is difficult.

There remains a need for a lighting fixture having a virtual axis wherein the lamp pivots about the virtual axis or the virtual center; and the diameter of the fixture housing will be reduced in size, such that the aperture of the fixture housing still allows all of the light from the lamp to pass out and through the fixture housing aperture.

DESCRIPTION OF THE PRIOR ART

Lighting fixtures that are rotatable having various designs, structures and configurations have been disclosed in the prior art. For example, U.S. Pat. No. 4,306,270 discloses an adjustable recessed electrical lighting fixture for a lamp. The lighting fixture is remotely controlled and employs motorized means for effecting adjustment of the beam of light emanating from the lamp. This prior art patent does not disclose the design, structure and configuration of the present invention.

U.S. Pat. No. 4,931,916 discloses an apparatus for mechanically adjusting the lighting fixture beam azimuth and elevation for light projectors used in light stage shows, concerts, discotheques, film and television productions. This prior art patent does not disclose the design, structure and configuration of the present invention.

U.S. Pat. No. 5,038,261 discloses an operating room light fixture having a cardanic mounting member connected to an overhead support beam by joints or linkages which rotate about horizontal and vertical axes. This prior art patent does not disclose the design, structure and configuration of the present invention.

U.S. Pat. No. 4,945,459 discloses a two-axis beam steering system for deflecting a light beam along any selected azimuth and elevational direction for use in automated light fixtures. The beam steering mechanism is movable without limitation about a pan axis and through a range of 180° degrees about a tilt axis, by drive motors that are rigidly mounted to the housing. This prior art patent does not disclose the design, structure and configuration of the present invention.

U.S. Pat. No. 4,736,278 discloses a lighting fixture with a rotating support. The lighting fixture includes a base, a cantilevered arm extending from the base and supporting a light, a rotatable platform, a motor for rotating the platform and electrical circuitry for actuating the light and/or the motor. This prior art patent does not disclose the design, structure and configuration of the present invention.

U.S. Pat. No. 4,112,486 discloses a remotely controlled positioning device for adjustably supporting a light unit for movement in any direction throughout a wide range of motion. The positioning device is electrically powered by a reversible motor, the shaft of which is provided with a support member for supporting the light unit for rotation about the axis of the motor shaft. This prior art patent does not disclose the design, structure and configuration of the present invention.

None of the prior art patents teach or disclose the structure and configuration of the virtual axis lighting fixture of the present invention wherein the lamp pivots about a virtual center or virtual axis, and the diameter of the fixture housing aperture is reduced in size, such that the aperture still allows all of the light from the lamp to pass out and through the fixture housing aperture.

Accordingly, it is an object of the present invention to provide a virtual axis lighting fixture which allows the light beam and fixture to rotate about a virtual center or virtual axis above or below the light fixture, the lamp or trim plane.

Another object of the present invention is to provide a virtual axis lighting fixture which provides a reduced width or smaller diameter of the fixture housing because the axis rotation (virtual center) is located above or below the lamp assembly.

Another object of the present invention is to provide a virtual axis lighting fixture that requires a smaller aperture in its fixture housing in order to allow all of the light to pass out of the fixture housing.

Another object of the present invention is to provide a virtual axis lighting fixture having a support and control assembly in which one assembly provides both support to the lamp assembly and controls the lamp assembly movement about the virtual center.

Another object of the present invention is to provide a virtual axis lighting fixture which can accommodate all types of lamps for this type of lighting fixtures, including halogen and incandescent lamps.

Another object of the present invention is to provide a virtual axis lighting fixture having a virtual center or virtual axis in order to provide a more compact fixture housing.

Another object of the present invention is to provide a virtual axis lighting fixture having a support and control assembly for providing both the support and control functions so as to provide a more compact fixture housing.

Another object of the present invention is to provide a virtual axis lighting fixture wherein the fixture housing is formed from light-weight stamped metals or molded from light-weight moldable plastics.

A further object of the present invention is to provide a virtual axis lighting fixture that can be mass produced in an automated and economical manner and is readily affordable.

SUMMARY OF THE INVENTION

In accordance with the present invention, there is provided a lighting fixture having a rotatable lamp assembly including a housing having a rear wall and two side walls for forming an interior compartment; the two side walls having first and second arc-shaped tracks formed therein; and the housing having mounting means for mounting the housing. The lighting fixture further includes a support and control assembly mounted within the interior compartment of the housing, and including a U-shaped support bracket having upper and lower arc-shaped tracks formed therein. The lighting fixture also includes first and second arc mounting plate members for movably mounting the support and control assembly on the first and second arc-shaped tracks on the two side walls for movement along the first and second arc-shaped tracks.

The lamp assembly has a third arc mounting plate member for movably mounting the lamp assembly on the upper and lower arc-shaped tracks of the U-shaped support bracket for movement along the upper and lower arc-shaped tracks. The lamp assembly rotates within the interior compartment of the housing fixture about a virtual center or virtual axis above the lamp assembly A pair of servomotors are provided for driving the support and control assembly and the lamp assembly for rotating the lamp assembly in a 360° degree circle. The servomotors rotate the lamp assembly in a circle about a radius of curvature having a center of curvature above the lamp assembly.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein.

DETAILED DESCRIPTION OF THE PREFERRED EMBODIMENT

Figure 1:
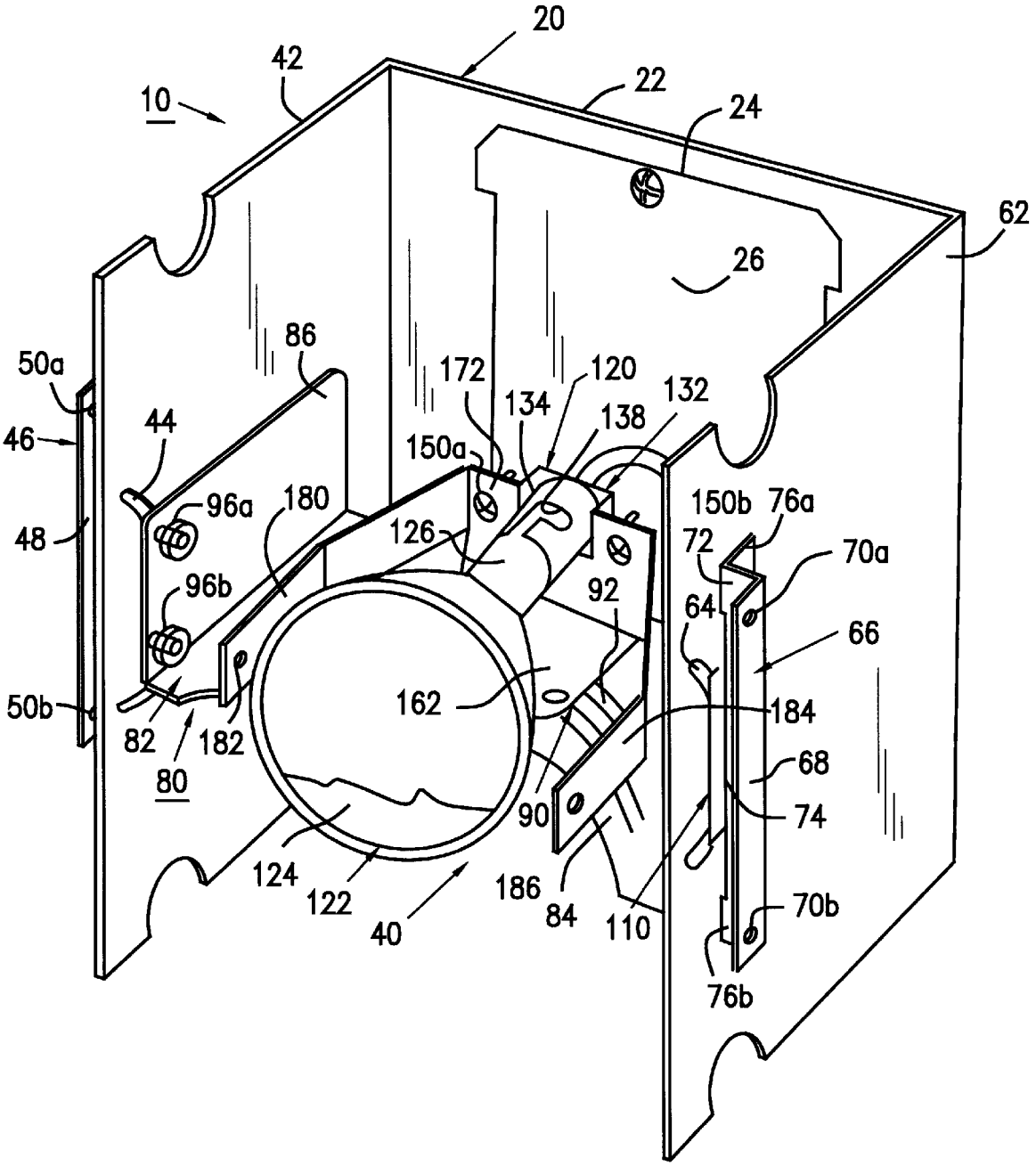
FIG. 1 is a front perspective view of the virtual axis lighting fixture of the preferred embodiment of the present invention showing its major component parts contained therein.

The virtual axis lighting fixture 10 and its component parts of the preferred embodiment of the present invention are represented in detail by FIGS. 1 through 7 of the drawings. The lighting fixture 10 includes a fixture housing 20 having mounting brackets 46 and 66, a support and control assembly 80 having a U-shaped support bracket 82 with first and second arc mounting plate members 100 and 110, a lighting fixture/lamp assembly 120, a servomotor 190 for rotatably moving the lamp assembly 120, and a servomotor 200 for rotatably moving the support and control assembly 80.

Lighting fixture 10 includes a fixture housing 20 having a rear wall 22 and side walls 42 and 62 for forming an interior compartment 40. Rear wall 22 includes a rectangular opening for an access panel 26 and a plurality of mounting openings 28. Access panel 26 includes a square opening 30 for receiving electrical connection wires 142*a*, 142*b* and 154, and a plurality of mounting openings 32 for mounting screws 34. Housing 20 is constructed and formed from durable, light-weight stamped metal (e.g. aluminum, stainless steel, etc.) or molded from light-weight, heat resistant, moldable plastics.

Side wall 42 includes an arc-shaped track or guide 44 formed therein for movably holding in place the first arc mounting plate member 100 therein. The outer surface of side wall 42 includes a first mounting bracket 46 for attaching fixture housing 20 to an interior lighting support structure (not shown).

Mounting bracket 46 includes an upper vertical side section 48 having a pair of mounting openings 50*a* and 50*b* therein; a horizontal center section 52 having an elongated rectangular opening 54 therein, being centrally located on the center section 52, and a pair of lower mounting tabs 56*a* and 56*b* for connectedly mounting the mounting bracket 46 to side wall 42. Vertical side section 48, horizontal center section 52 and lower mounting tabs 56*a* and 56*b* are all integrally connected to form the mounting bracket 46.

Side wall 62 includes an arc-shaped track or guide 64 formed therein for movably holding in place the second arc mounting plate member 110 therein. The outer surface of side wall 62 includes a second mounting bracket 66 for attaching fixture housing 20 to an interior lighting support structure (not shown).

Mounting bracket 66 includes an upper vertical side section 68 having a pair of mounting openings 70*a* and 70*b* therein, a horizontal center section 72 having an elongated rectangular opening 74 therein, being centrally located on the center section 72, and a pair of lower mounting tabs 76*a* and 76*b* for connectedly mounting the mounting bracket 66 to side wall 62. Vertical side section 68, horizontal center section 72 and lower mounting tabs 76*a* and 76*b* are all integrally connected to form the mounting bracket 66.

Figure 2:
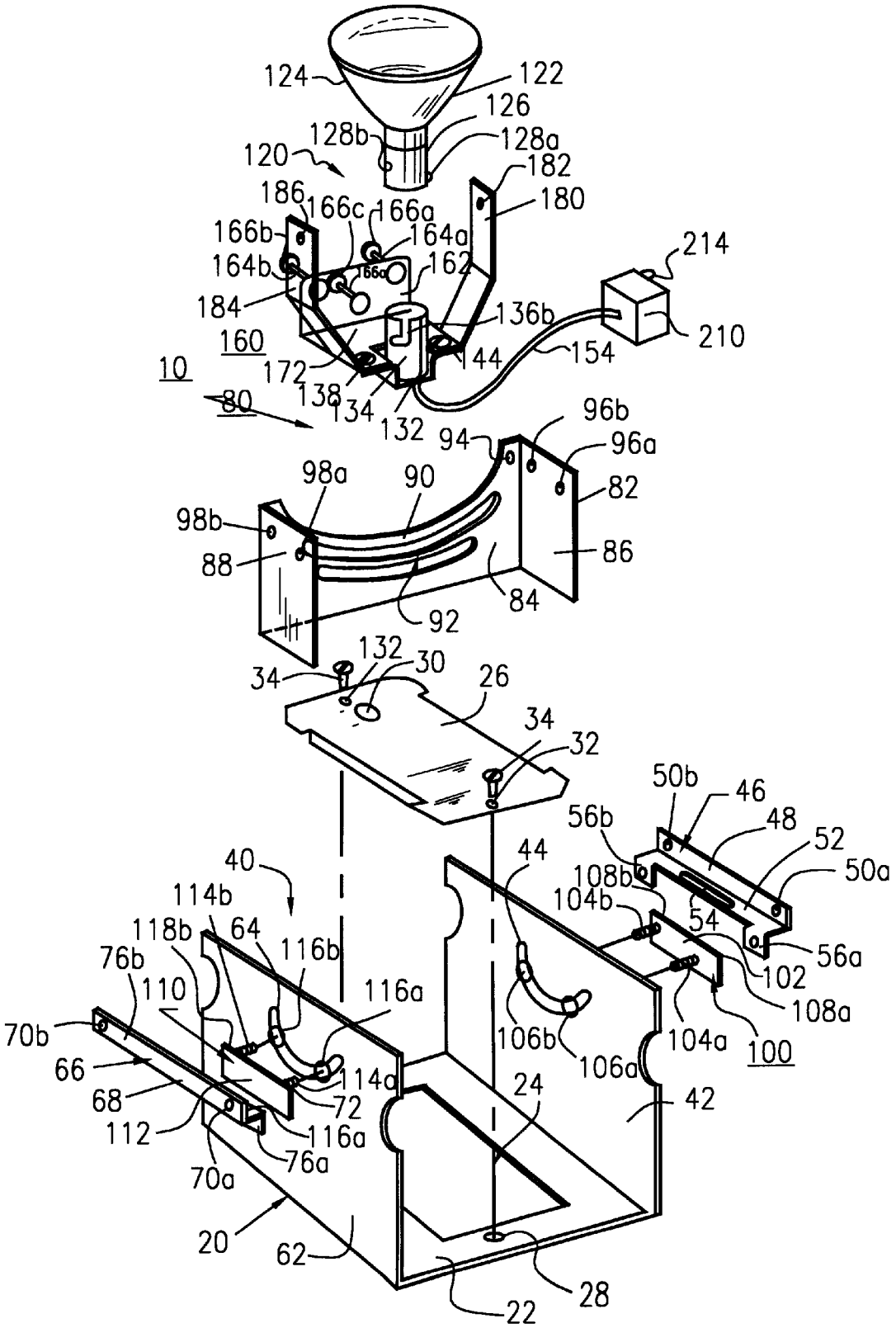
FIG. 2 is an exploded front perspective view of the virtual axis lighting fixture of the preferred embodiment of the present invention showing the fixture housing having mounting brackets thereon, the support and control assembly, the lamp fixture assembly, and the power supply.
Figure 3:
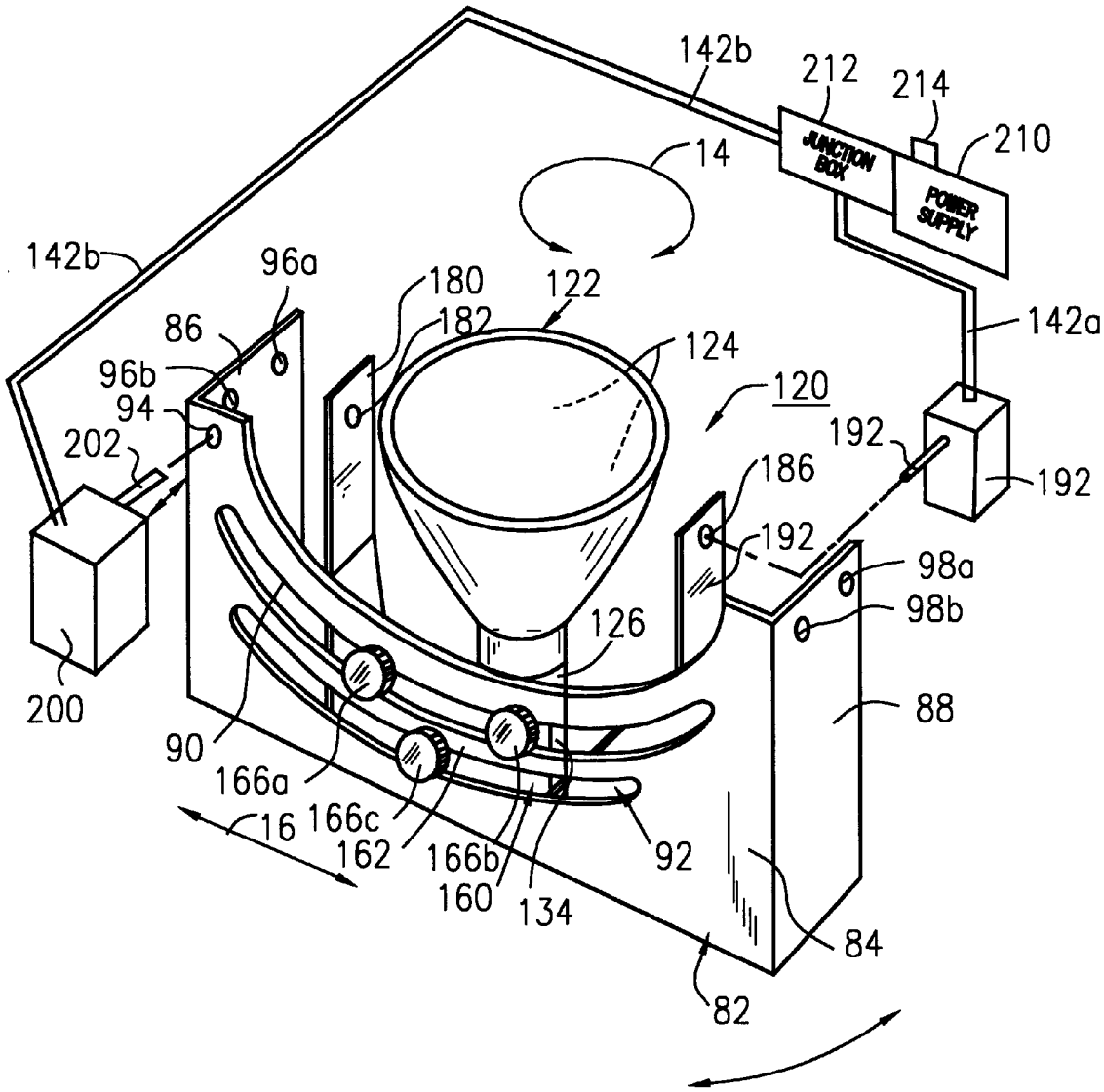
FIG. 3 is an enlarged front perspective view of the virtual axis lighting fixture of the present invention showing the support and control assembly having a U-shaped support bracket, first and second arc mounting plate members, the lamp fixture assembly having a halogen reflector lamp, a lamp socket member, a U-shaped lamp socket bracket, and a third arc mounting plate member, and the servomotors.
Figure 4:
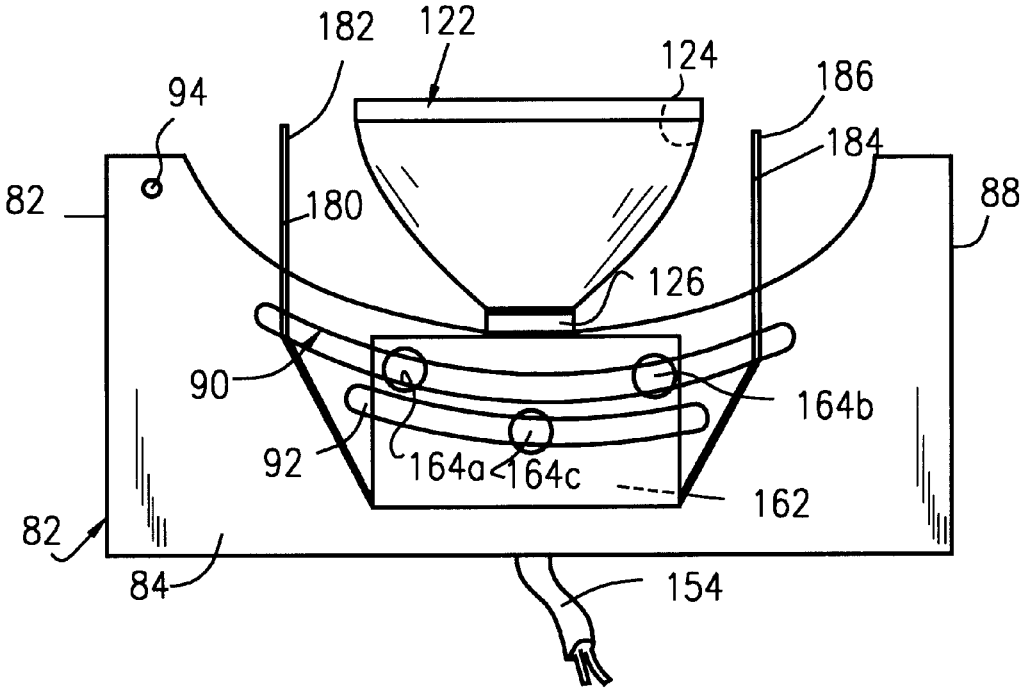
FIG. 4 is a front elevational view of the virtual axis lighting fixture of the present invention showing the fixture housing, the support and control assembly, and the lamp fixture assembly.
Figure 5:
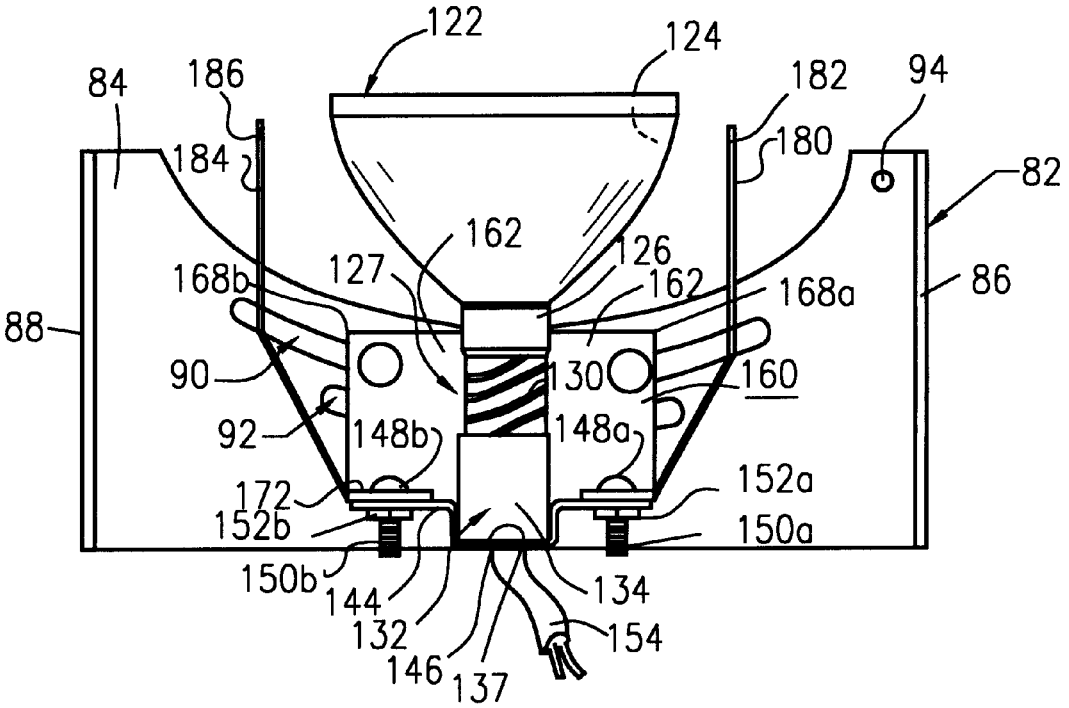
FIG. 5 is a rear elevational view of the virtual axis lighting fixture of the present invention showing the fixture housing, the support and control assembly, and the lamp fixture assembly.

Support bracket 82 of support and control assembly 80 is U-shaped in configuration, as shown in FIGS. 2 and 3, and includes a center plate section 84, first and second end plate sections 86 and 88, all being integrally connected together to form the U-shaped support bracket 82. Center plate section 84 has an upper arc-shaped track or guide 90 and a lower arc-shaped track or guide 92 formed therein. Center plate section 84 further includes a mounting opening 94 for receiving shaft 202 of servomotor 200. Support bracket 82 is constructed and formed from durable, light-weight. stamped metal (e.g. aluminum, steel, stainless steel) or molded from light-weight, heat resistant, moldable plastics.

First end plate section 86 includes a pair of wheel shaft openings 96*a* and 96*b* formed therein for receiving wheel shafts 104*a* and 104*b*, respectively, of first arc mounting plate member 100. Second end plate section 88 includes a pair of wheel shaft openings 98*a* and 98*b* formed therein for receiving wheel shafts 114*a* and 114*b*, respectively, of second arc mounting plate member 110.

First arc mounting plate member 100 includes a center plate section 102 having a pair of wheel shafts 104*a* and 104*b* mounted thereon, and with each wheel shaft 104*a* and 104*b* having a tracking wheel 106*a* and 106*b* mounted thereon, respectively, for movably tracking the wheels 106*a* and 106*b* within the first arc-shaped track 44 on side wall 42. Wheel shafts 104*a* and 104*b* are centrally located on center plate section 102 with each wheel shaft 104*a* and 104*b* being adjacent to the center plate section edges 108*a* and 108*b*, respectively. Second arc mounting plate member 110 includes a center plate section 112 having a pair of wheel shafts 114*a* and 114*b* mounted thereon, and with each wheel shaft 114*a* and 114*b* having a tracking wheel 116*a* and 116*b* mounted thereon, respectively, for movably tracking the wheels 116*a* and 116*b* within the second arc-shaped track 64 on side wall 62. Wheel shafts 114*a* and 114*b* are centrally located on center plate section 112 with each wheel shaft 114*a* and 114*b* being adjacent to the center plate section edges 118*a* and 118*b*, respectively.

Lighting fixture assembly/lamp assembly 120 includes a halogen reflector lamp 122, a lamp socket member 132, a U-shaped lamp socket bracket 144 and a third arc mounting plate member 160. Halogen reflector lamp 122 includes a lamp reflector component 124 and a stem portion 126 having mounting means 127 thereon. Mounting means 127 are in the form of a pair of mounting tabs 128*a* and 128*b* or spiral/concentric grooves 130 on stem portion 126 for connecting to the socket receptacle 134 having cooperating lamp receiving means 135 therein.

Lamp socket member 132 includes a socket receptacle 134 having lamp receiving means 135 in the form of a pair L-shaped mounting tracks 136*a* and 136*b* for use in conjunction with a receptacle mounting spring 138 for holding lamp 122 in place or an internal spiral receiving groove 140 for receiving the external spiral groove 130 of stem 126 on lamp 122. Socket receptacle 134 also includes an electrical connection wire 154 attached to the bottom section 137 of receptacle 134.

Lamp socket bracket 144 has a U-shaped configuration and includes a circular and centrally located opening 146 for receiving of the socket receptacle 134 therein and a pair of mounting openings 148*a* and 148*b* for connecting to the third arc mounting plate member 160 via bolts/screws and nuts 150*a*, 152*a*, 150*b* and 152*b*, respectively. Although a halogen lamp 122 has been shown, the present invention may be used with any type of lamp including incandescent, fluorescent, neon and the like.

Third arc mounting plate member 160 includes a back plate section 162, a bottom plate section 172 and a pair of side plate sections 180 and 184, all being integrally connected to form mounting plate member 160. Third arc mounting plate member 160 includes a back plate section 162 having three wheel shafts 164*a*, 164*b* and 164*c* mounted thereon, and with each wheel shaft 164*a*, 164*b*, and 164*c* having a tracking wheel 166*a*, 166*b*, and 166*c* mounted thereon, respectively, for movably tracking the wheels 166*a*, 166*b* and 166*c* within the upper and lower arc-shaped tracks 90 and 92. Tracking wheels 166*a* and 166*b* move along the upper track 90 and tracking wheel 166*c* moves along the lower track 92. Wheel shafts 164*a* and 164*b* are located in the upper corners 168*a* and 168*b* of back plate section 162 and wheel shaft 164*c* is centrally located and adjacent to the bottom perimeter edge 170 of back plate section 162.

Bottom plate section 172 includes a centrally located cut-out opening 174 for receiving socket receptacle 134 therethrough, and a pair of mounting openings 176*a* and 176*b* for connecting to the U-shaped lamp socket bracket 144 via the bolts/screws and nuts, 150*a*, 152*a*, 150*b* and 152*b*, respectively. Side plate sections 180 and 184 each have an opening 182 and 186 therein for receiving motor shaft 192 of servomotor 190 within one of the openings 182 or 186.

Servomotors 190 and 200 are provided and include motor shafts 192 and 202, respectively, for producing transverse and lateral movement. Servomotor 190 and shaft 192 rotatably drive lamp assembly 120, and servomotor 200 and shaft 202 rotatably drive support and control assembly 80. Servomotors 190 and 200 in concurrent use with the U-shaped support bracket 82 and lamp assembly 120, respectively, combine to produce movement of the lamp assembly about a 360° degree radius 14. Servomotors 190 and 200 are electrically connected to a power supply 210 via electrical connection wires 142*a* and 142*b* from a common electrical junction box 212 for simultaneous activation by power switch 214, as shown in the electrical schematic drawing of FIG. 7.

Figure 7:
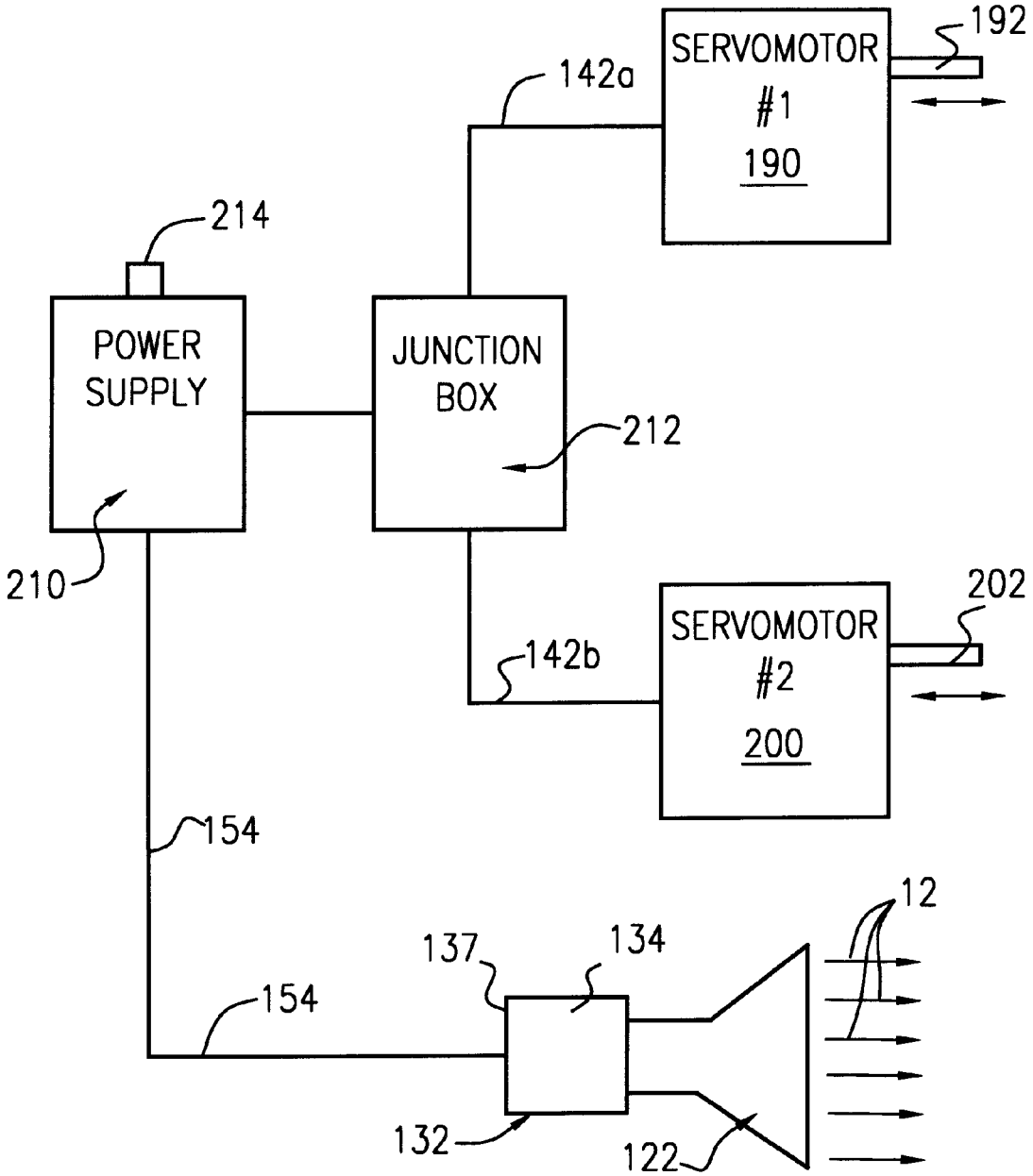
FIG. 7 is an electrical schematic diagram of the virtual axis lighting fixture of the present invention showing the electrical connections to its component parts.
Figure 8:
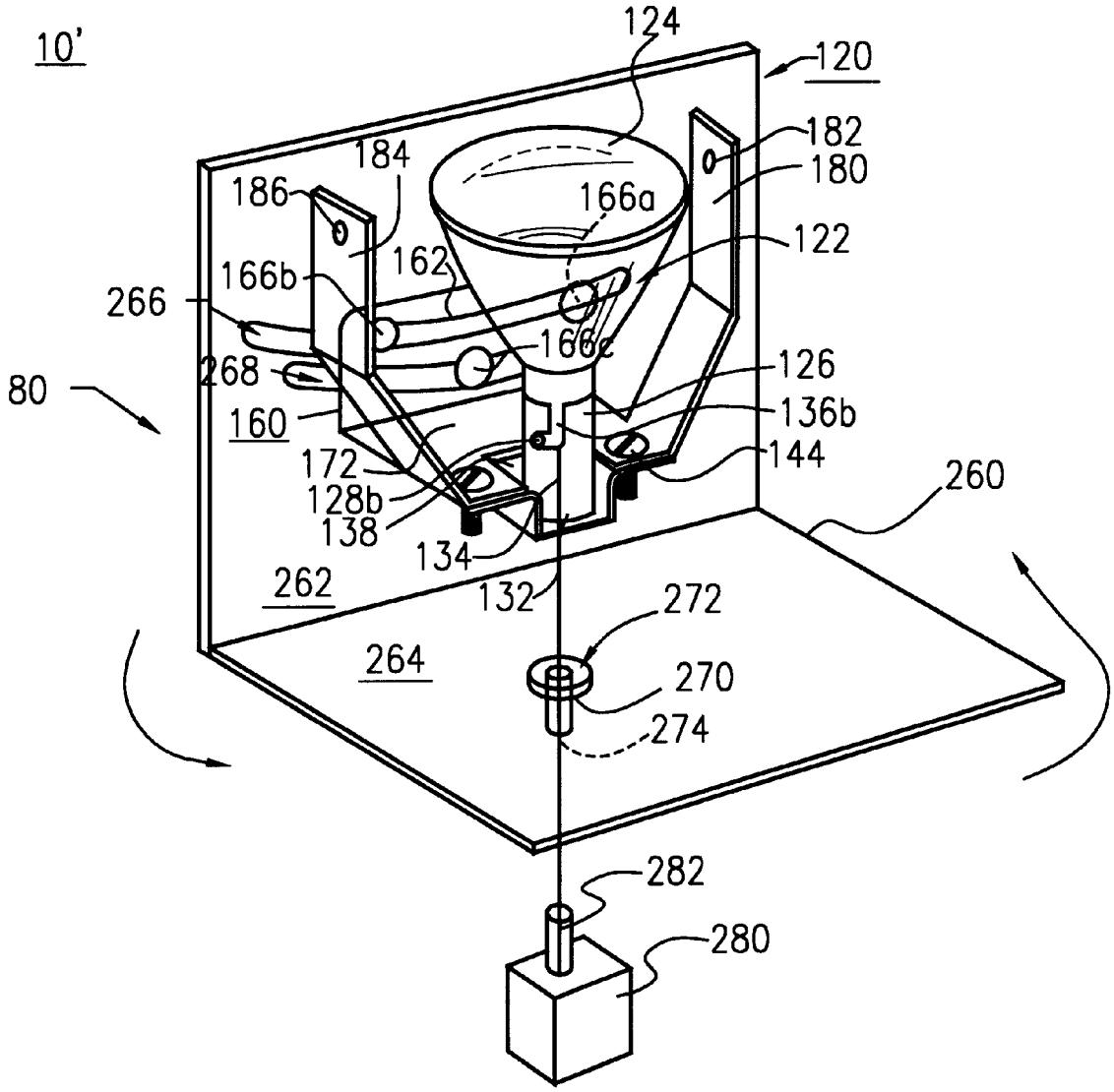
FIG. 8 is a front perspective view of the virtual axis lighting fixture of an alternate embodiment of the present invention showing the fixture housing, the support and control assembly having an L-shaped support and swivel bracket, and the lamp fixture assembly.

Socket receptacle 134 is electrically connected to a power supply 210 via electrical connection wire 154 for activation and turning-on reflector lamp 122 via lamp socket 216, as shown in FIG. 7 of the drawings.

DETAILED DESCRIPTION OF THE ALTERNATE EMBODIMENT

In an alternate embodiment, the virtual axis lighting fixture 10' includes an L-shaped support and swivel bracket 260 as a component part of the support and control assembly 80. The L-shaped support and swivel bracket 260 is used as an alternate part for the U-shaped support bracket 82 of the preferred embodiment, which then eliminates the need for arc-shaped tracks 44 and 64 in side walls 42 and 62, respectively, as well as eliminates the need for the arc mounting plate members 100 and 110 also. In all other respects, the virtual axis lighting fixture 10' of the second alternate embodiment operates and functions in a similar manner to the virtual axis lighting fixture 10 of the preferred embodiment. The remaining component parts of the virtual axis lighting fixture 10' are exactly the same as the component parts of the virtual axis lighting fixture 10 of the preferred embodiment.

The L-shaped support and swivel bracelet 260, as shown in FIG. 10 of the drawings, includes a vertical wall member 262 integrally attached to a horizontal wall member 264. Vertical wall member 262 includes an upper arc-shaped track or guide 266 and a lower arc-shaped track or guide 268. Tracking wheels 166*a*, 166*b* and 166*c* of the arc mounting plate member 160 are used for movably tracking the aforementioned wheels 166*a*, 166*b* and 166*c* within the upper and lower arc-shaped tracks 266 and 268. Tracking wheels 166*a* and 166*b* move along the upper track 266 and tracking wheel 166*c* moves along the lower track 268.

Horizontal wall member 264 includes a centrally located swivel opening 270 for receiving therein a swiveling mount member 272. Swiveling mount member includes a hollow shaft 274 for receiving therein motor shaft 282 of a miniature rotating motor 280. Motor 280 enables the horizontal wall member 264 to rotate in 360° degree circular motion, as shown in FIG. 10.

OPERATION OF THE PRESENT INVENTION

In operation, as shown in FIG. 1 of the drawings, the user turns ON the power switch 214 to power supply/source 210 for activating servomotors 190 and 200. Servomotors 190 and 200 are activated in order to rotatably move the lamp assembly 120 continuously at a particular azimuth and elevational level within housing 20, or to rotatably move the lamp assembly 120 to a selected stationary position at a particular azimuth and elevational level within fixture housing 20. The servomotors combine to rotatably drive and move lamp assembly 120 along a 360° degree circle about a virtual center or center of curvature 17 in order to focus and direct the light beam 12 from the aperture opening 38 of housing 20. This circular movement 14 is produced in the following manner. The motor shaft 192 of servomotor 190 is attached to opening 182 of side plate section 180 of the mounting plate member 160, and motor shaft 192 reciprocates transversely such that mounting plate member 160 moves the lamp assembly 120 via tracking wheels 166*a* to 166*c* within the upper and lower arc-shaped tracks 90 and 92, respectively, in an arc-shaped path 16.

Concurrently, the motor shaft 202 of servomotor 200 is attached to opening 94 on center plate section 84 of support bracket 82, and motor shaft 202 reciprocates laterally such that first and second arc mounting plate members 100 and 110 move the U-shaped support bracket 82 via tracking wheels 106*a*, 106*b*, 116*a* and 116*b* within the arc-shaped tracks 44 and 64 of side walls 42 and 62, respectively, as shown in FIG. 1 of the drawings, in an arc-shaped path 18.

These concurrent arc-shaped movements 16 and 18 combine to produce a circular movement 14 about the virtual center 17 of lamp assembly 120 moving within a 360° degree circular radius, as shown in FIG. 1 of the drawings.

Figure 6:
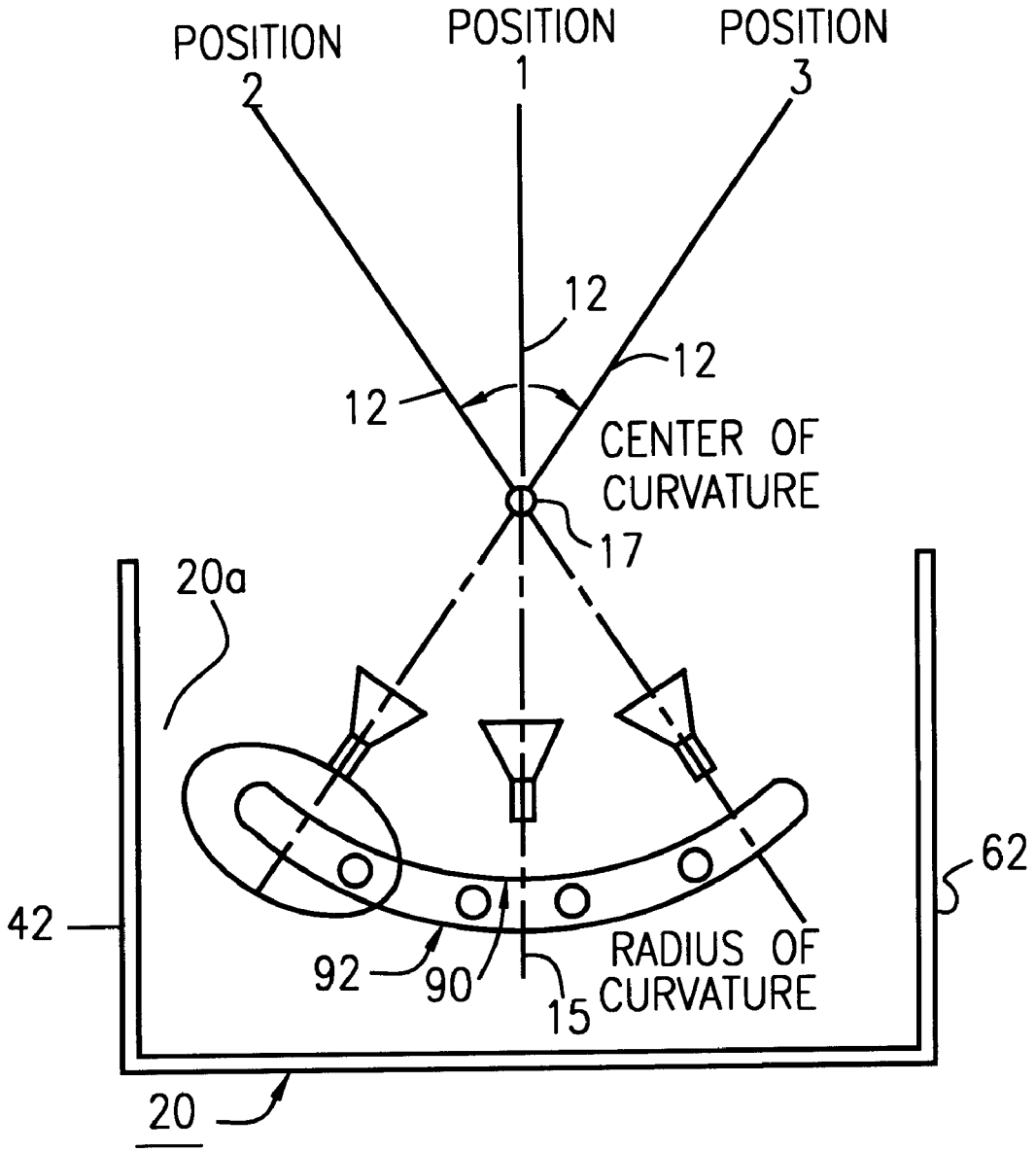
FIG. 6 is a schematic diagram of the virtual axis lighting fixture of the preferred embodiment of the present invention showing the center of curvature and radius of curvature of the lamp fixture assembly.

As shown in FIG. 6, the lamp assembly 120 moves along an arc 90, 92 and at each end of the arc (positions 2 and 3), the entire light beam 12 passes out of the aperture 20*a* of the housing 20, without hitting the side walls 42, 62 of the housing. Further, because the lamp assembly 120 moves about a virtual center 17 above the lamp assembly 120, the diameter of housing 20 is substantially reduced. Also, as shown in FIG. 6, the lamp assembly 120 moves along an arc 90, 92 having a radius of curvature 15, with the center of curvature 17 of the arc defining the virtual center or virtual axis about which the lamp assembly 120 moves.

ADVANTAGES OF THE PRESENT INVENTION

Accordingly, an advantage of the present invention that it provides for a virtual axis lighting fixture which allows the light beam and fixture to rotate about a virtual center or virtual axis above the light fixture.

Another advantage of the present invention is that it provides for a virtual axis lighting fixture which provides a reduced width or smaller diameter of the fixture housing because the axis rotation (virtual center) is located above the lamp assembly.

Another advantage of the present invention is that it provides for a virtual axis lighting fixture that requires a smaller aperture in its fixture housing in order to allow all of the light to pass out of the fixture housing.

Another advantage of the present invention is that it provides for a virtual axis lighting fixture having a support and control assembly in which one assembly provides both support to the lamp assembly and controls the lamp assembly movement about the virtual center.

Another advantage of the present invention is that it provides for a virtual axis lighting fixture which can accommodate all types of lamps for this type of lighting fixtures.

Another advantage of the present invention is that it provides for a virtual axis lighting fixture having a virtual center or virtual axis in order to provide a more compact fixture housing.

Another advantage of the present invention is that it provides for a virtual axis lighting fixture having a support and control assembly for providing both the support and control functions so as to provide a more compact fixture housing.

Another advantage of the present invention is that it provides for a virtual axis lighting fixture wherein the fixture housing is formed from light-weight stamped metals or molded from light-weight moldable plastics.

A further advantage of the present invention is that it provides for a virtual axis lighting fixture that can be mass produced in an automated and economical manner and is readily affordable.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed:

1. A lighting fixture having a rotatable lamp assembly, comprising:

a) a housing having a rear wall and side walls for forming an interior compartment; said side walls each having an arc-shaped track formed therein; and said housing having mounting means for mounting said housing;

b) a support and control assembly mounted within said interior compartment of said housing, and including control means having at least one arc-shaped track formed therein;

c) first means for movably mounting said support and control assembly on said arc-shaped tracks on said side walls for movement along said arc-shaped tracks; and d) said lamp assembly having second means for movably mounting said lamp assembly on said at least one arc-shaped track for movement along said at least one arc-shaped track.

2. A lighting fixture in accordance with claim 1, further including drive means for driving said support and control assembly for rotating said lamp assembly in a 360° degree circle.

3. A lighting fixture in accordance with claim 2, wherein said drive means rotates said lamp assembly in a circle about a radius of curvature having a center of curvature above said lamp assembly.

4. A lighting fixture in accordance with claim 2, wherein said drive means includes a first servomotor and shaft for driving said support and control assembly, and a second servomotor and shaft for driving said lamp assembly.

5. A lighting fixture in accordance with claim 1, wherein said first means for movably mounting said support and control assembly includes first rolling means for rolling on said arc-shaped tracks, and wherein said second means for movably mounting said lamp assembly includes second rolling means for rolling on said upper and lower arc-shaped tracks.

6. A lighting fixture in accordance with claim 5, wherein said first rolling means include a pair of tracking wheels.

7. A lighting fixture in accordance with claim 5, wherein said second rolling means include a plurality of tracking wheels.

8. A lighting fixture in accordance with claim 1, wherein said mounting means include first and second mounting brackets attached to said side walls of said housing for mounting said housing.

9. A lighting fixture in accordance with claim 1, wherein said control means includes a U-shaped support bracket having first and second end sections and a center section, said center section having said upper and lower arc-shaped tracks formed therein.

10. A lighting fixture in accordance with claim 9, wherein said first means for movably mounting includes first and second arc mounting plate members.

11. A lighting fixture in accordance with claim 10, wherein said first and second arc mounting plate members are attached to said first and second end sections, respectively, of said U-shaped support bracket.

12. A lighting fixture in accordance with claim 9, wherein said U-shaped support bracket is made from durable, light-weight stamped metals selected from the group consisting of aluminum and stainless steel.

13. A lighting fixture in accordance with claim 9, wherein said U-shaped support bracket is made from durable, light-weight, heat resistant moldable plastic.

14. A lighting fixture in accordance with claim 1, wherein said second means for movably mounting includes a third arc mounting plate member attached to said lamp assembly.

15. A lighting fixture in accordance with claim 14, wherein said lamp assembly includes a reflector lamp, a lamp socket member, a lamp socket bracket and said third arc mounting plate member.

16. A lighting fixture in accordance with claim 1, wherein said housing is made from durable, light-weight stamped metals selected from the group consisting of aluminum and stainless steel.

17. A lighting fixture in accordance with claim 1, wherein said housing is made from durable, light-weight, heat resistant moldable plastic.

18. A lighting fixture having a rotatable lamp assembly, comprising:

a) a housing having a rear wall and side walls for forming an interior compartment; said side walls each having an arc-shaped track formed therein; and said housing having mounting means for mounting said housing;

b) a support and control assembly movably mounted on said arc-shaped tracks within said interior compartment of said housing, and including control means having at least one arc-shaped track formed therein; and c) said lamp assembly having means for movably mounting said lamp assembly on said at least one arc-shaped track for movement along said at least one arc-shaped track.

19. A lighting fixture in accordance with claim 18, further including means for rotatably mounting said support and control assembly on said rear wall of said housing.

20. A lighting fixture in accordance with claim 19, further including drive means for driving said support and control assembly for rotating said lamp assembly in a 360° degree circle.

21. A lighting fixture in accordance with claim 20, wherein said drive means rotates said lamp assembly in a circle about a radius of curvature having a center of curvature above said lamp assembly.

22. A lighting fixture in accordance with claim 20, wherein said drive means includes a first servomotor and shaft for driving said support and control assembly, and a second servomotor and shaft for driving said lamp assembly.

23. A lighting fixture in accordance with claim 19, wherein said means for rotatably mounting said support and control assembly includes first rolling means for rolling on said arc-shaped tracks, and wherein said means for movably mounting said lamp assembly includes second rolling means for rolling on said upper and lower arc-shaped tracks.

24. A lighting fixture in accordance with claim 23, wherein said first rolling means include a pair of tracking wheels.

25. A lighting fixture in accordance with claim 23, wherein said second rolling means include a plurality of tracking wheels.

26. A lighting fixture in accordance with claim 19, wherein said mounting means include first and second mounting brackets attached to said side walls of said housing for mounting said housing.

27. A lighting fixture in accordance with claim 18, wherein said control means includes a U-shaped support bracket having first and second end sections and a center section, said center section having said upper and lower arc-shaped tracks formed therein.

28. A lighting fixture in accordance with claim 27, wherein said means for rotatably mounting includes first and second arc mounting plate members.

29. A lighting fixture in accordance with claim 28, wherein said first and second arc mounting plate members are attached to said first and second end sections, respectively, of said U-shaped support bracket.

30. A lighting fixture in accordance with claim 27, wherein said U-shaped support bracket is made from durable, light-weight stamped metals selected from the group consisting of aluminum and stainless steel.

31. A lighting fixture in accordance with claim 27, wherein said U-shaped support bracket is made from durable, light-weight, heat resistant moldable plastic.

32. A lighting fixture in accordance with claim 18, wherein said means for movably mounting includes a third arc mounting plate member attached to said lamp assembly.

33. A lighting fixture in accordance with claim 32, wherein said lamp assembly includes a reflector lamp, a lamp socket member, a lamp socket bracket and said third arc mounting plate member.

34. A lighting fixture in accordance with claim 18, wherein said housing is made from durable, light-weight stamped metals selected from the group consisting of aluminum and stainless steel.

35. A lighting fixture in accordance with claim 18, wherein said housing is made from durable, light-weight, heat resistant moldable plastic.

36. A lighting fixture having a rotatable lamp assembly, comprising:

a) A housing having a rear wall and side walls for forming an interior compartment; said side walls each having an arc-shaped track formed therein; and said housing having mounting means for mounting said housing;

b) a support and control assembly mounted within said interior compartment of said housing, and including control means having upper and lower arc-shaped tracks formed therein;

c) first means for movably mounting said support and control assembly on said arc-shaped tracks on said side walls for movement along said arc-shaped tracks;

d) said lamp assembly having second means for movably mounting said lamp assembly on said upper and lower arc-shaped tracks for movement along said upper and lower arc-shaped tracks; and e) drive means for driving said support and control assembly and said lamp assembly for rotating said lamp assembly in a 360° degree circle.

37. A lighting fixture in accordance with claim 36, wherein said drive means rotates said lamp assembly in a circle about a radius of curvature having a center of curvature above said lamp assembly.

38. A lighting fixture in accordance with claim 36, wherein said first means for movably mounting said support and control assembly includes first rolling means for rolling on said arc-shaped tracks, and wherein said second means for movably mounting said lamp assembly includes second rolling means for rolling on said upper and lower arc-shaped tracks.

39. A lighting fixture in accordance with claim 38, wherein said first rolling means include a pair of tracking wheels.

40. A lighting fixture in accordance with claim 38, wherein said second rolling means include a plurality of tracking wheels.

41. A lighting fixture in accordance with claim 36, wherein said mounting means include first and second mounting brackets attached to said side walls of said housing for mounting said housing.

42. A lighting fixture in accordance with claim 36, wherein said control means includes a U-shaped support bracket having first and second end sections and a center section, said center section having said upper and lower arc-shaped tracks formed therein.

43. A lighting fixture in accordance with claim 42, wherein said first means for movably mounting includes first and second arc mounting plate members.

44. A lighting fixture in accordance with claim 43, wherein said first and second arc mounting plate members are attached to said first and second end sections, respectively, of said U-shaped support bracket.

45. A lighting fixture in accordance with claim 42, wherein said U-shaped support bracket is made from durable, light-weight stamped metals selected from the group consisting of aluminum and stainless steel.

46. A lighting fixture in accordance with claim 42 wherein said U-shaped support bracket is made from durable, light-weight, heat resistant moldable plastic.

47. A lighting fixture in accordance with claim 36, wherein said second means for movably mounting includes a third arc mounting plate member attached to said lamp assembly.

48. A lighting fixture in accordance with claim 47, wherein said amp assembly includes a reflector lamp, a lamp socket member, a lamp socket bracket and said third arc mounting plate member.

49. A lighting fixture in accordance with claim 36, wherein said drive means includes a first servomotor and shaft for driving said support and control assembly, and a second servomotor and shaft for driving said lamp assembly.

50. A lighting fixture in accordance with claim 36, wherein said housing is made from durable, light-weight stamped metals selected from the group consisting of aluminum and stainless steel.

51. A lighting fixture in accordance with claim 36, wherein said housing is made from durable, light-weight, heat resistant moldable plastic.

52. A lighting fixture having a rotatable lamp assembly, comprising:

a) a housing having a rear wall and side walls for forming an interior compartment; said side walls each having an arc-shaped track formed therein; and said housing having mounting means for mounting said housing;

b) a support and control assembly mounted within said interior compartment of said housing; said support and control assembly including control means in the form of a U-shaped support bracket having first and second end sections and a center section; first and second arc mounting members attached to said first and second end sections, respectively, of said U-shaped support bracket; and said center section having upper and lower arc-shaped tracks formed therein;

c) said first and second arc mounting members for movably mounting said support and control assembly on said arc-shaped tracks on said side walls for movement along said arc-shaped tracks;

d) said lamp assembly having a third arc mounting member for movably mounting said lamp assembly on said upper and lower arc-shaped tracks for movement along said upper and lower arc-shaped tracks; and e) drive means for driving said support and control assembly and said lamp assembly for rotating said lamp assembly in a 360° degree circle.

53. A lighting fixture in accordance with claim 52, wherein said drive means rotates said lamp assembly in a circle about a radius of curvature having a center of curvature above said lamp assembly.

54. A lighting fixture in accordance with claim 52, wherein said first means for movably mounting said support and control assembly includes first rolling means for rolling on said arc-shaped tracks, and wherein said second means for movably mounting said lamp assembly includes second rolling means for rolling on said upper and lower arc-shaped tracks.

55. A lighting fixture in accordance with claim 54, wherein said first rolling means include a pair of tracking wheels.

56. A lighting fixture in accordance with claim 54, wherein said second rolling means include a plurality of tracking wheels.

57. A lighting fixture in accordance with claim 54, wherein said U-shaped support bracket is made from durable, light-weight stamped metals selected from the group consisting of aluminum and stainless steel.

58. A lighting fixture in accordance with claim 54, wherein said U-shaped support bracket is made from durable, light-weight, heat resistant moldable plastic.

59. A lighting fixture in accordance with claim 52, wherein said mounting means include first and second mounting brackets attached to said side walls of said housing for mounting said housing.

60. A lighting fixture in accordance with claim 52, wherein said first and second arc mounting members are attached to said first and second end sections, respectively, of said U-shaped support bracket.

61. A lighting fixture in accordance with claim 52, wherein said lamp assembly includes a reflector lamp, a lamp socket member, a lamp socket bracket and said third arc mounting plate member.

62. A lighting fixture in accordance with claim 52, wherein said drive means includes a first servomotor and shaft for driving said support and control assembly, and a second servomotor and shaft for driving said lamp assembly.

63. A lighting fixture in accordance with claim 52, wherein said housing is made from durable, light-weight stamped metals selected from the group consisting of aluminum and stainless steel.

64. A lighting fixture in accordance with claim 52, wherein said housing is made from durable, light-weight, heat resistant moldable plastic.

65. A lighting fixture having a rotatable lamp assembly, comprising:

a) a housing having an interior compartment;

b) a lamp assembly movably mounted within said interior compartment;

c) first means for moving said lamp assembly in a first plane; and d) second means for moving said lamp assembly in a second plane perpendicular to said first plane so that simultaneous movement in said first and second planes results in rotation of said lamp assembly.

66. A lighting fixture in accordance with claim 65, wherein said first means for moving includes a first arc-shaped track and wherein said second means for moving includes a second arc-shaped track.

67. A lighting fixture having a rotatable lamp assembly, comprising:

a) a housing having an interior compartment;

b) a lamp assembly movably mounted within said interior compartment;

c) first means for moving said lamp assembly in a first plane; and d) second means for rotating said lamp assembly in a second plane while said lamp assembly is moving in said first plane.

* * * * *